US007259507B2

(12) United States Patent
Kurita et al.

(10) Patent No.: US 7,259,507 B2
(45) Date of Patent: Aug. 21, 2007

(54) LOW PRESSURE DISCHARGE LAMP HAVING EXTERNAL ELECTRODES PROVIDED WITH HEAT EQUALIZING MEMBERS

(75) Inventors: Takayoshi Kurita, Ehime (JP); Yuji Takeda, Ehime (JP); Tomomasa Hirao, Ehime (JP)

(73) Assignee: Harison Toshiba Lighting Corporation, Ehime (JP)

( * ) Notice: Subject to any disclaimer, the term of this patent is extended or adjusted under 35 U.S.C. 154(b) by 389 days.

(21) Appl. No.: 10/867,824

(22) Filed: Jun. 16, 2004

(65) Prior Publication Data

US 2004/0256968 A1 Dec. 23, 2004

(30) Foreign Application Priority Data

Jun. 19, 2003 (JP) ..... 2003-175325

(51) Int. Cl.
*H01J 65/00* (2006.01)
*H01J 11/00* (2006.01)
*H01J 11/02* (2006.01)

(52) U.S. Cl. ..... 313/234; 313/607; 313/11; 313/594

(58) Field of Classification Search ..... 313/234, 313/607, 594
See application file for complete search history.

(56) References Cited

U.S. PATENT DOCUMENTS 6,914,391 B2 * 7/2005 Takeda et al. ..... 315/223
2004/0135484 A1 * 7/2004 Lim ..... 313/234
2004/0222743 A1 * 11/2004 Takagi et al. ..... 313/634

FOREIGN PATENT DOCUMENTS

| | | | |
|---|---|---|---|
| EP | 1515361 A1 * | 3/2005 | |
| JP | 5265740 | 5/1977 | |
| JP | 11040109 A * | 2/1999 | |
| JP | 2000141078 | 5/2000 | |
| JP | 200176682 | 3/2001 | |
| JP | 2003187751 A * | 7/2003 | |
| KR | 2003067127 A * | 8/2003 | |
| WO | WO 03056883 A1 * | 7/2003 | |

* cited by examiner

*Primary Examiner*—Mariceli Santiago
(74) *Attorney, Agent, or Firm*—Banner & Witcoff, Ltd.

(57) ABSTRACT

A dielectric barrier discharge type low pressure discharge lamp 11 includes dielectric barrier discharge type external electrodes 21, 22 on external ends of a tubular glass lamp vessel 10, electrically conductive material layers 31, 32 on the external surface of the tubular glass lamp vessel, and heat equalizing members 41, 42, which are provided on the electrically conductive material layer. With the constitution, the surface temperature of the external electrodes 21, 22 can be equalized with a local temperature rise avoided, thereby a longer life of the lamp can be assured.

17 Claims, 3 Drawing Sheets

LOW PRESSURE DISCHARGE LAMP HAVING EXTERNAL ELECTRODES PROVIDED WITH HEAT EQUALIZING MEMBERS

TECHNICAL FIELD

The present invention relates to a low pressure discharge lamp.

BACKGROUND TECHNOLOGY OF THE INVENTION

A dielectric barrier discharge type low pressure discharge lamp (EEFL) is known, which is provided with electrodes on an external surface of a tubular glass lamp vessel, as described in the Japanese official gazette of the utility model laid open No. 61-126559, for example. The configuration of the conventional low pressure discharge lamp is shown in FIG. 3.

In FIG. 3, a low pressure discharge lamp 15 has a tubular glass lamp vessel 10, both ends of which are sealed. An ionizable discharge medium 50 such as rare gas or a mixed gas of mercury and rare gas, is enclosed inside the tubular glass lamp vessel 10. A phosphor layer 60 etc. is formed on the inner surface of the tubular glass lamp vessel, if necessary. External electrodes 25, 26 are provided on the outer surface of both ends of the tubular glass lamp vessel. The external electrodes 25, 26 are made of electrical conductive material layers 35, 36 such as, for example, a metal foil attached on the glass surface through an adhesive layer, such as in an aluminum tape electrode. Electricity feeding members 75, 76 are attached on the external electrodes 25, 26, while lead wires 81,82 are attached on the electricity feeding members 75, 76.

A low pressure discharge lamp 15 with such construction has an advantage that the consumption of electrodes is avoided and the life is long, because the electrodes are not provided inside the glass lamp vessel 10.

However, when the electrical conductive material layer 35, 36 are formed by a metal foil such as an aluminum tape electrode, a high lamp voltage must be applied to the conductive material layer 35, 36 due to an insufficient contact with the tubular glass lamp vessel 10 and to a high electric resistance of the conductive material layer 35, 36 themselves. To solve the problem it is proposed to form the external electrodes with a solder layer using an ultrasonic solder dipping method. A lamp voltage becomes lower in such an external electrode type lamp having a metal layer such as a solder electrode directly formed on a glass surface than an external electrode type lamp having a metal foil attached on an external surface of the glass lamp vessel through an adhesive layer, such as an aluminum tape electrode since the electric resistance of the electrodes themselves can be small due to their sufficiently thin thickness. Therefore, there is also an advantage that circuit design of an inverter for generating high voltage high frequency electric power becomes easier.

However, a solder electrode has a low heat capacity because the thickness is about one twentieth as thin as that of the aluminum tape electrode. For this reason, the solder electrode tends to exhibit partially uneven electrode temperature distribution compared with aluminum tape electrode. For example, in the conventional example shown in FIG. 3, where the electricity feeding members 75, 76 are provided only in the vicinity of a central portion, the temperature in the central portion of the electrode tends to decrease by heat dissipation, while the temperature on the both ends of the electrode, where electricity feeding members are not arranged, tends to become high. Therefore, there was a problem that the electrode temperature became locally high at the vicinity of the ends of the electrodes, and thus the glass material is molten to form a hole, which enables the lamp to be lit.

One of the objects of the present invention is to solve such problems, and to provide a low pressure discharge lamp in which adverse effects due to the local temperature rise in the external electrode surfaces formed by a solder layer are reduced.

DISCLOSURE OF THE INVENTION

The low pressure discharge lamp according to one aspect of the present invention includes a tubular glass lamp vessel, both ends of which are sealed and in which a discharge medium is filled, external electrodes, which are provided on an external surface of the tubular glass lamp vessel and to which a high frequency voltage is applied, wherein the external electrodes include an electrically conductive material layer, which is provided in close contact with the external surface of the tubular glass lamp vessel, and a heat equalizing member provided on the surface of the electrically conductive material layer.

Further, in the low pressure discharge lamp according to the present invention, the electrically conductive material layer is a solder layer.

Further, in the low pressure discharge lamp according to another aspect the present invention, the heat equalizing member is a spring coil wound around the external surface of the electrically conductive material layer.

Further, in the low pressure discharge lamp according to other aspect of the present invention, the solder layer is made of a solder, the major component of which is tin, an alloy of tin and indium, or an alloy of tin and bismuth.

Further, in the low pressure discharge lamp according to another aspect of the present invention, the solder layer is a solder layer produced by ultrasonic solder dipping.

As mentioned above, in the low pressure discharge lamp according to an embodiment of the present invention, the surface temperature of the external electrode becomes uniform, and an adverse effect due to the partial heat increase in the electrically conductive material layer can be eliminated.

DETAILED DESCRIPTION OF THE INVENTION

The embodiments according to the present invention will be explained in detail referring to the figures below.

Figure 1:
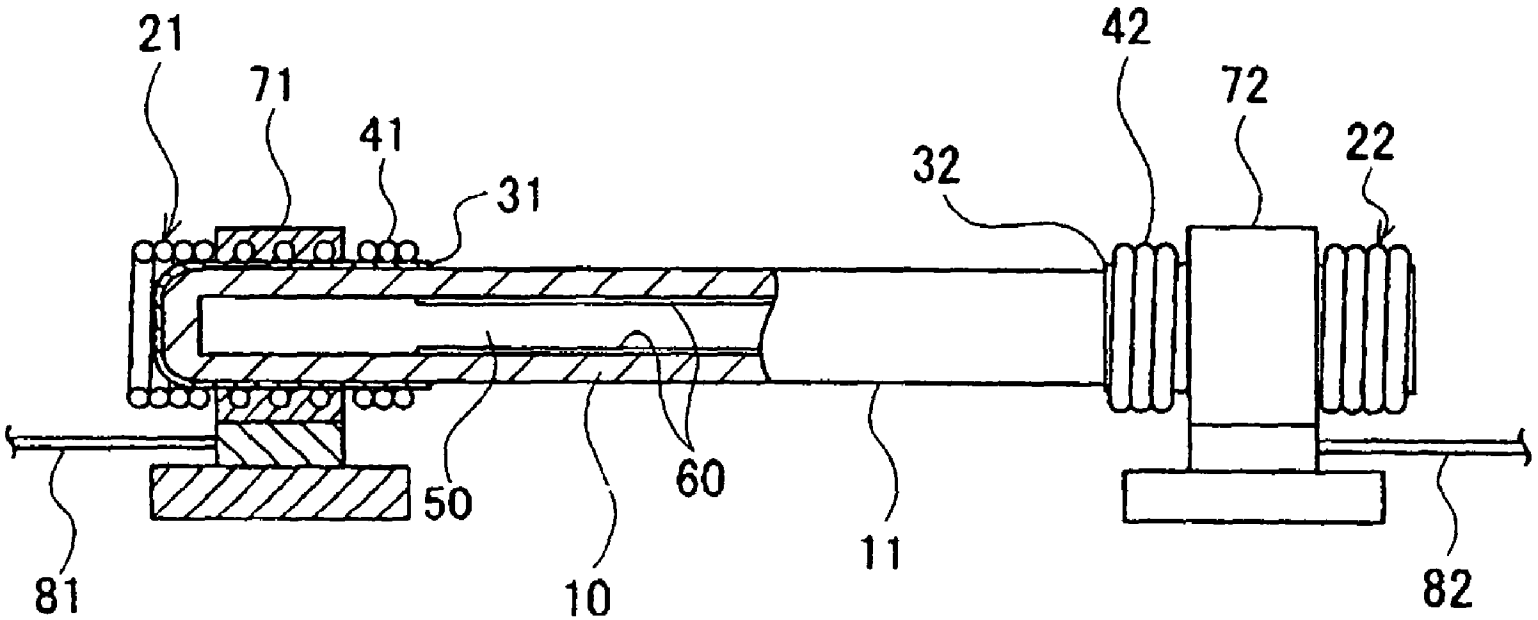
FIG. 1 is a side view of a lamp according to a first embodiment of the present invention, in which a part of the lamp along a lamp axis is shown in a section.

FIG. 1 shows a low pressure discharge lamp 11 which is a first embodiment of the present invention. The low pressure discharge lamp 11 is a dielectric barrier discharge type low pressure discharge lamp, having a tubular glass lamp vessel 10 made of boron-silicate glass, both ends of which are sealed. The size is as follows; an outer diameter is 2.2 mm, an inner diameter is 2.0 mm, and a total length is 350 mm. An ionizable filler 50 composed of rare gas or a mixed gas of mercury and rare gas etc. is enclosed inside the tubular glass lamp vessel 10. The filler 50 is, for example, a mixed gas of neon and argon, where the composition ratio is 90 mol % neon and 10 mol % argon, and charged pressure is 8 kPa. Mercury of 3 mg is enclosed. A phosphor layer 60 is formed on the inner surface of the tubular glass lamp vessel 10, if necessary.

Electrically conductive material layers 31, 32, which are produced by ultrasonic solder dipping, are provided on both ends of the external surface of the tubular glass lamp vessel 10. The length of the electricity conducting layers 31, 32 is, for example, 17 mm. The electricity conducting layers 31, 32 are formed by dipping the end of the tubular glass lamp vessel 10 into an ultrasonic soldering bath. By dipping the tube ends into an ultrasonic soldering bath, electricity conducting layers 31, 32 can be formed on the ends of the tubular glass lamp vessel 10 with a uniform thickness without exposing the lamp surface. An ultrasonic solder dipping is a method in which an ultrasonic transducer is provided inside a molten solder bath and plating is performed while an ultrasonic oscillation is being applied on molten solder.

As is described, a mass production of low pressure discharge lamp 11 with low price and high performance becomes possible by forming electrically conductive material layers 31, 32 for the external electrodes 21, 22 of the tubular glass lamp vessel 10 by ultrasonic solder dipping. Here, a strong and solid ultrasonic solder dipping layer can be formed by selecting as a major component any of tin, an alloy of tin and indium, or an alloy of tin and bismuth as a solder material for forming electrically conductive material layers 31, 32 by ultrasonic solder dipping. Further, the electrically conductive material layers 31, 32 stick well to the surface of the tubular glass lamp vessel 10 and become hard to be peeled off by adding at least one selected from the group consisting of antimony, zinc and aluminum to the solder material. Further, low pressure discharge lamps good for environments can be produced by using a solder material free of lead.

Spring coils 41, 42 are wound around the external surface of the electricity conducting layers 31, 32, as heat equalizing members. Thus the external electrodes 21, 22 are composed of the electricity conducting layers 31, 32 and the spring coils 41, 42. Electricity feeding members 71, 72 are mounted on the external periphery of the spring coil 41, 42, and lead wires 81, 82 are connected with the electricity feeding members 71, 72.

The spring coils 41, 42 are wires are made of, for example, phosphor bronze of 0.2 mm diameter, and are formed by winding them into a coil with an inner diameter of 2.55 mm. A way of winding the spring coils 41, 42 is that, the winding pitch is large at the portion where the electricity feeding members 71, 72 are mounted, while the winding pitch is small at both ends where the electricity feeding members 71, 72 are not mounted. The reason is as follows. The winding pitch of the spring coil 41, 42 is made large to prevent the temperature of the electrode from being too low at the central portion of the electrode, where the portion electricity feeding members 71, 72 are mounted and is easy to radiate heat. On the contrary, the winding pitch of the spring coils 41, 42 are made small at the both ends of the electrodes, where the electricity feeding members 71, 72 are not mounted to make the heat capacity of the electrode high and to prevent the temperature of the electrodes from rising, because the heat radiation by electricity feeding members 71, 72 is rarely expected.

The low pressure discharge lamp according to the first embodiment thus constituted is lighted by being supplied with HF pulse from an HF pulse source composed of inverter circuit etc. (not illustrated) through the electricity feeding members 71, 72 to the external electrodes 21, 22. That is, discharge is generated inside the tubular glass lamp vessel 10 through a discharge medium by an HF pulse voltage supplied between the external electrodes 21, 22. With the discharge generated, the phosphor layer 60, formed on the inner wall of the tubular glass lamp vessel 10 if necessary, is excited to generate a visible light.

During the lighting operation, the external electrodes 21, 22 generate heat by an electrical resistance between the tubular glass lamp vessel 10 and the external electrodes 21, 22 respectively. However in the above embodiment, the temperature distribution at the external electrodes 21, 22 becomes uniform because spring coils 41, 42 are wound around the portion of the electricity conducting layers 31, 32. Therefore, a dielectric barrier discharge type low pressure discharge lamp with long life can be obtained, because there is no fear that the temperature of the external electrodes 21, 22 will become locally too high to melt the glass material and finally to generate a hole.

Further, the external electrodes 21, 22 can be stuck fast on the glass surface with a uniform thickness, because the electrically conductive material layers 31, 32 for the external electrodes 21, 22 are formed by ultrasonic dipping. Thus, the voltage of the HF power source, which is supplied to the low pressure discharge lamp 11 for discharging, can be made low, because the impedance for HF current at the portion of external electrodes 21, 22 can be made low.

Figure 2:
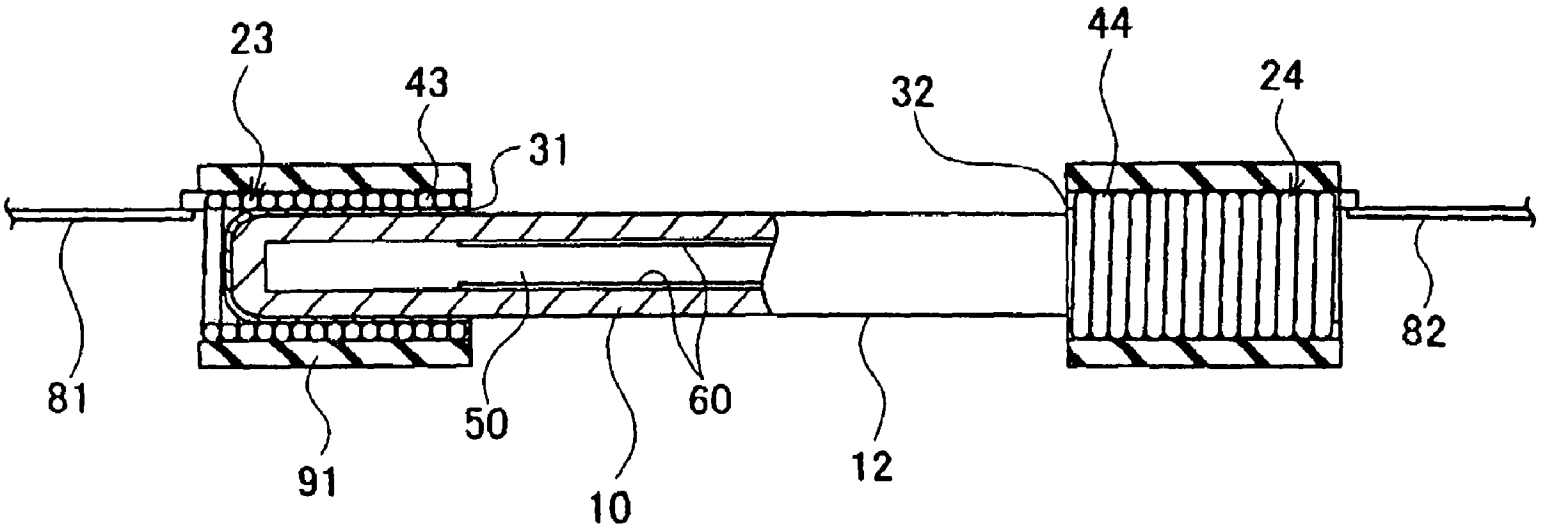
FIG. 2 is a side view showing a lamp according to a second embodiment of the present invention, in which a part of the lamp along a lamp axis is shown in a section.

Next, the low pressure discharge lamp 12 according to the second embodiment of the present invention will be explained referring to FIG. 2. In the embodiment, electrically conductive material layers 31, 32 are formed on both ends of an outer surface of the tubular glass lamp vessel 10 by ultrasonic solder dipping, in the similar fashion to the first embodiment. On the outer surface of the electricity conductive layers 31, 32, spring coils 43, 44, are provided, which are wound at nearly uniform pitch along the entire length of the layers 31, 32. On the ends of the spring coils 43, 44, lead wires 81, 82 are connected. The material, size of the spring coils 43, 44 are the same as those in the first embodiment. However, the spring coils 43, 44 in the second embodiment are wound at a nearly uniform winding pitch and the electricity feeding members 71, 72 in the first embodiment are omitted. The outer surfaces of the spring coils 43, 44 are covered with rubber holders 91, 92 to support spring coils 43, 44 together with external electrodes 23, 24 integrally, as well as to provide electrical insulation.

In the low pressure discharge lamp 12 according to the second embodiment, the temperature distribution at the portion of the external electrodes 21, 22 becomes uniform, by providing spring coils 43, 44 having a uniform winding pitch for electricity feeding members on the outer surface of the electrically conductive material layers 31, 32, which are formed by the ultrasonic dipping.

Figure 3:
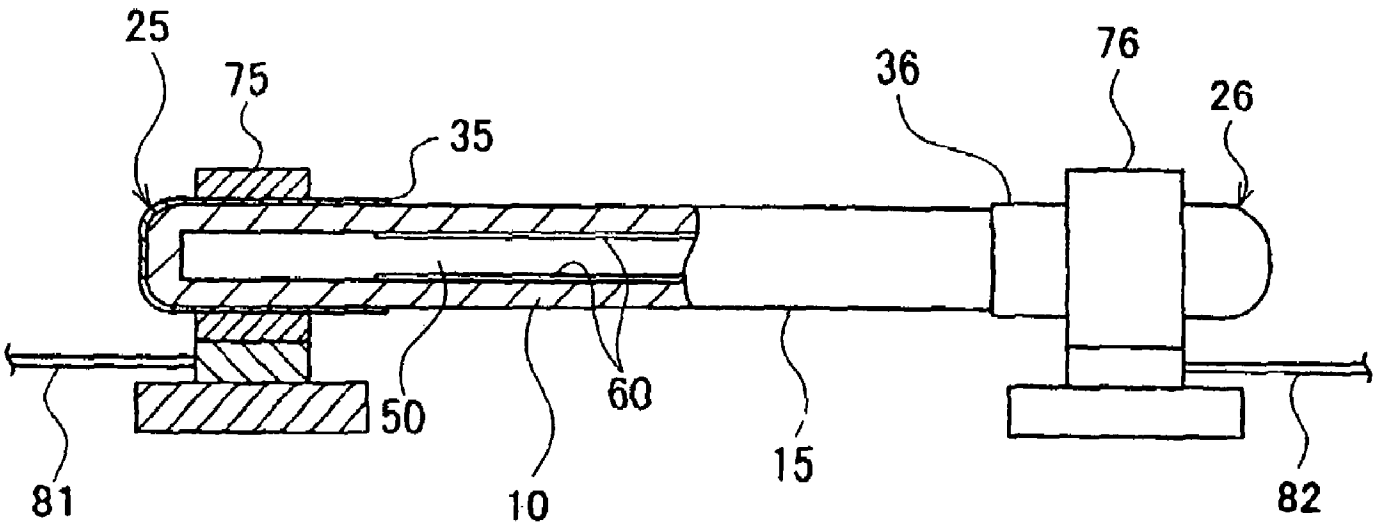
Fig. 3 (Prior Art)
FIG. 3 is a side view of a conventional lamp, in which a part of the lamp along a lamp axis is shown in a section.

The characteristics of the low pressure discharge lamp of the second embodiment is compared with that of the conventional discharge lamp (comparison sample) shown in FIG. 3. That is, the low pressure discharge lamps according to the second embodiment and of the comparison sample are lighted with lamp current of 8 mA, and the temperature distribution of the electrode portion is measured. As the result, the comparison sample showed uneven temperature distribution at the electrode portion, with 200° C. on the both ends of the external electrodes. On the contrary, the temperature distribution at the both ends of the electrode was uniform, with the temperature of 180° C. in the low pressure discharge lamp according to the present embodiment. Thus, it was confirmed that the heat distribution of the external electrode was made uniform in the low pressure discharge lamp of the embodiment.

Therefore, in the low pressure discharge lamp according to the second embodiment, there is no fear that the temperature of the external electrodes 21, 22 becomes locally high and that the glass material will melt to generate a hole, providing a dielectric barrier discharge lamp of long life. Further, the layers 31, 32 can be stuck fast to the glass surface with a uniform thickness, because the electrically conductive material layers 31, 32 of the external electrodes 21, 22 are formed by ultrasonic dipping similarly to the first embodiment. Thus, the voltage for discharging the low pressure discharge lamp 11 can be made low.

Here, although the electrically conductive material layers 31, 32 of the external electrode are formed by the ultrasonic solder dipping in the first and second embodiments. However, other methods for forming may be used. For example, the electrically conductive material layers 31, 32 may be formed by dipping in a conventional molten solder bath, in which a solder with a major component being any one of, tin, an alloy of tin and indium, or an alloy of tin and bismuth, is melting. Also in this case, electrically conductive material layers having a good adhesion property with glass with a uniform thickness may be obtained, thereby providing a similar operation and advantage to the first and second embodiment.

As mentioned above, according to the embodiments of the present invention, since the surface temperature of the external electrodes can be made uniform, an adverse effect due to the local temperature rise can be eliminated, and a long life lamp is provided.

The invention claimed is:

1. A low pressure discharge lamp comprising:

a tubular glass lamp vessel, both ends of which are sealed and in which a discharge medium is enclosed, and external electrodes, which are provided on the external surface of both ends of the tubular glass lamp vessel and to which a high frequency voltage is applied, wherein the external electrodes further comprise an electrically conductive solder layer, which is adhered on an external surface of the tubular glass lamp vessel, and a heat equalizing spring coil wound around a surface of the electrically conductive solder layer.

2. A low pressure discharge lamp according to claim 1, wherein a ring shape electricity feeding member is provided on the external electrode, which is in contact with the outer surface of the spring coil.

3. A low pressure discharge lamp according to claim 2, wherein the spring coil has a small winding pitch at both ends of the external electrode and has a large winding pitch at a center portion of the external electrode along the tube axis, and wherein the ring shape electricity feeding member is provided at the center portion of the spring coil along the tube axis.

4. A low pressure discharge lamp according to claim 1, wherein the spring coil is wound with nearly constant pitch along the entire length of the external electrode, and lead wires are connected to end portions of the spring coil.

5. A low pressure discharge lamp according to claim 4, wherein the outer surface of the spring coil is covered with a tubular rubber holder.

6. A low pressure discharge lamp according to claim 1, wherein the electrically conductive solder layer has major component that is any one of, tin, an alloy of tin and indium, or an alloy of tin and bismuth.

7. A low pressure discharge lamp according to claim 6, wherein the heat equalizing member is formed by winding a spring coil around the outer surface of the solder.

8. A low pressure discharge lamp according to claim 7, wherein the external electrode is further provided with a ring shape electricity feeding member, which is in contact with an outer surface of the spring coil.

9. A low pressure discharge lamp according to claim 8, wherein the spring coil has a small winding pitch at both ends of the external electrode and has a large winding pitch at the center portion of the external electrode in a tube axis direction, the ring shape electricity feeding member is provided at the center portion of the spring coil in the tube axis direction.

10. A low pressure discharge lamp according to claim 7, wherein the spring coil is wound with nearly constant pitch along the entire length of the external electrode in the tube axis direction, and lead wires are connected to the end portions of the spring coil.

11. A low pressure discharge lamp according to claim 10, wherein the outer surface of the spring coil is covered with a tubular rubber holder.

12. A low pressure discharge lamp according to claim 1, wherein the electrically conductive solder layer is formed by ultrasonic solder dipping.

13. A low pressure discharge lamp according to claim 12, wherein the external electrode is further provided with a ring shape electricity feeding member, which is in contact with the outer surface of the spring coil.

14. A low pressure discharge lamp according to claim 13, wherein the spring coil has a small winding pitch at both ends of the external electrode in the tube axis direction and has a large winding pitch at the center portion of the external electrode in the tube axis direction, and wherein a ring shape electricity feeding member is provided at the center portion of the spring coil in the tube axis direction.

15. A low pressure discharge lamp according to claim 13, wherein the spring coil is wound with nearly constant pitch along the entire length of the external electrode in the tube axis direction, and lead wires are connected at the ends of the spring coil.

16. A low pressure discharge lamp according to claim 15, wherein the outer surface of the spring coil is covered with a tubular rubber holder.

17. A low pressure discharge lamp according to claim 12, wherein the electrically conductive material layer is a solder layer which is produced by dipping in a molten solder bath, in which a solder is molten having a major component of any one of, tin, an alloy of tin and indium, or an alloy of tin and bismuth.

* * * * *